US008733133B2

(12) United States Patent
Shin et al.

(10) Patent No.: US 8,733,133 B2
(45) Date of Patent: May 27, 2014

(54) WASHING MACHINE AND DRAWER ASSEMBLY THEREOF

(75) Inventors: Kyoung Seop Shin, Seoul (KR); Jin Doo Kim, Hwaseong-si (KR); Yong Sok Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 769 days.

(21) Appl. No.: 12/588,582

(22) Filed: Oct. 20, 2009

(65) Prior Publication Data

US 2010/0175435 A1 Jul. 15, 2010

(30) Foreign Application Priority Data

Jan. 12, 2009 (KR) ..... 10-2009-0002207

(51) Int. Cl.
*D06F 39/02* (2006.01)
*A47B 95/02* (2006.01)

(52) U.S. Cl.
USPC ..... 68/17 R; 312/228; 312/330.1

(58) Field of Classification Search
USPC ..... 68/17 R; 312/330.1, 332.1, 348.4, 405, 312/228; 16/430, 412, 415
See application file for complete search history.

(56) References Cited

U.S. PATENT DOCUMENTS

| | | | | |
|---|---|---|---|---|
| 2004/0093913 | A1* | 5/2004 | Bolduan et al. | 68/17 R |
| 2007/0075614 | A1* | 4/2007 | Calmeise | 312/326 |
| 2007/0125134 | A1* | 6/2007 | Park | 68/17 R |
| 2007/0138922 | A1* | 6/2007 | Frederick et al. | 312/109 |
| 2007/0151302 | A1* | 7/2007 | Kendall et al. | 68/3 R |
| 2007/0266740 | A9* | 11/2007 | Kendall et al. | 68/3 R |
| 2009/0322195 | A1* | 12/2009 | Joerger et al. | 312/334.1 |

FOREIGN PATENT DOCUMENTS

| | | | |
|---|---|---|---|
| CN | 1779044 | | 5/2006 |
| CN | 200950922 | | 9/2007 |
| EP | 2003237 | A1 * | 12/2008 |
| JP | 03095380 | A * | 4/1991 |
| JP | 2000097550 | A * | 4/2000 |
| JP | 2006046837 | A * | 2/2006 |
| KR | 20-1992-0001303 | | 2/1992 |
| KR | 20-0392583 | | 8/2005 |
| WO | WO 2004048723 | A1 * | 6/2004 |

OTHER PUBLICATIONS

Chinese Office Action Chinese Office Action issued May 2, 2012 (filed in the IDS on Jul. 9, 2012) in corresponding to the Chinese Patent Application No. 200910222024 , English translation.

* cited by examiner

*Primary Examiner* — Joseph L Perrin
(74) *Attorney, Agent, or Firm* — Staas & Halsey LLP

(57) ABSTRACT

Disclosed herein are a washing machine, which has an improved structure to increase the aesthetic appearance and emotional quality of a detergent container, and a drawer assembly of the washing machine. The washing machine includes a washing machine main body, a detergent container connected to the washing machine main body, a drawer panel provided on the detergent container and including a frame part having a predetermined thickness, and a handle defined within the frame part of the drawer panel.

10 Claims, 6 Drawing Sheets

WASHING MACHINE AND DRAWER ASSEMBLY THEREOF

CROSS-REFERENCE TO RELATED APPLICATIONS

This application claims the benefit of Korean Patent Application No. 2009-0002207, filed on Jan. 12, 2009, in the Korean Intellectual Property Office, the disclosure of which is incorporated herein by reference.

BACKGROUND

1. Field

Embodiments of the present invention relate to a washing machine, which has an improved structure to increase the aesthetic appearance and emotional quality of a detergent container, and a drawer assembly of the washing machine.

2. Description of the Related Art

In general, washing machines are divided into a pulsator washing machine, which rotates washing water and laundry using a pulsator rotatably installed on the bottom of the inside of a tub to achieve washing of the laundry, an agitator washing machine, which agitates washing water and laundry using an agitator protruding from the center of the inside of a tub to achieve washing of the laundry, and a drum washing machine, which repeats raising and dropping of laundry by rotating a drum containing the laundry to achieve washing of the laundry.

As described above, there are various kinds of washing machines, and each of all kinds of washing machine includes a drawer assembly to mix a detergent with washing water and supply the mixture to a washing chamber.

The drawer assembly includes a housing, which is typically installed in the front region of the upper portion of a main body of a washing machine and is provided with an opened front surface, and a detergent container, which comes into or out of the inside of the housing through the opened front surface of the housing in a drawer type.

SUMMARY

Additional aspects and/or advantages will be set forth in part in the description which follows and, in part, will be apparent from the description, or may be learned by practice of the invention.

Therefore, it is an aspect of the present embodiment to provide a washing machine, which has an improved structure to increase the aesthetic appearance and emotional quality of a detergent container, and a drawer assembly of the washing machine.

Additional aspects will be set forth in part in the description which follows and, in part, will be obvious from the description, or may be learned by practice of the invention.

The foregoing and/or other aspects are achieved by providing a washing machine including a washing machine main body, a detergent container connected to the washing machine main body, a drawer panel provided on the detergent container and including a frame part having a predetermined thickness, and a handle defined within the frame part of the drawer panel.

The handle may be defined through at least one of an upper surface and a side surface of the frame part.

The handle may include a depression surface depressed from the frame part.

Further, the handle may include a depression surface depressed from the at least one of the upper surface and the side surface of the frame part to form a designated space.

The depression surface may be formed as a curved surface, which is gradually inclined in a downward direction.

The depression surface may include a first bending surface depressed from the upper surface in a height direction of the frame part, and a first seating surface extended from the first bending surface in a width direction of the frame part.

The first seating surface may be rounded from the first bending surface, and may be inclined and extended.

A housing, to which the detergent container is connected, may be formed in the washing machine main body, guide rails may be formed along an inner surface of the housing, and the first seating surface may be disposed at a same line as the guide rails when the detergent container is attached to the housing.

The depression surface may further include a second bending surface depressed from the first seating surface in the height direction, and a second seating surface extended from the second bending surface in the width direction so as to be connected with the side surface.

A control panel to control an operation of the washing machine and a front cover formed on a front surface of the washing machine main body may be provided on the washing machine main body, and the outer surface of the drawer panel may be coplanar with outer surfaces of the control panel and the front panel when the detergent container is mounted to the washing machine main body.

The front surface of the drawer panel may be flat.

The foregoing and/or other aspects are achieved by providing a washing machine including a washing machine main body, a detergent container housing disposed within the washing machine main body and including guide rails disposed on opposing sides thereof, a detergent container connected to the detergent container housing through the guide rails, a drawer panel provided on the detergent container and including a frame part having a predetermined thickness, and a handle defined within the frame part of the drawer panel, the handle including a depression surface provided in the frame part, and having a minimum height difference with the guide rails to which the detergent container is connected.

The foregoing and/or other aspects are achieved by providing a washing machine including a washing machine main body, a detergent container connected to the washing machine main body, a drawer panel provided on the detergent container and including a frame part having a predetermined thickness, and a handle defined within a side of the frame part of the drawer panel to improve user access to the handle.

The foregoing and/or other aspects are achieved by providing a drawer assembly including a housing, a detergent container detachably connected to the housing, a drawer panel provided on a front surface of the detergent container, a frame part connecting a front surface and a rear surface of the drawer panel, and a handle defined within the frame part.

The handle may be defined through at least one of an upper surface and a side surface of the frame part.

The handle may include a depression surface depressed from the at least one of the upper surface and the side surface of the frame part.

The depression surface may include at least one bending surface depressed from the upper surface in a height direction of the frame part, and at least one seating surface extended from the at least one bending surface in a width direction of the frame part.

Guide rails to guide the attachment and detachment of the detergent container to and from the housing may be formed on opposing sides of the housing, and any one of the at least one seating surface may be disposed at a same line as the guide rails.

The foregoing and/or other aspects are achieved by providing a detergent container for a washing machine, including: a detergent input unit configured to receive detergent; a drawer panel connected with the detergent input unit and including a frame part having a predetermined thickness; and a handle defined through at least one of an upper surface and a side surface of the frame part and configured to receive a user's fingertips.

The handle may be gradually inclined from the upper surface of the frame part.

The handle may be gradually inclined from the upper surface of the frame part to the side surface of the frame part.

The foregoing and/or other aspects are achieved by providing a front drawer panel of a detergent container for a washing machine, including: a front surface; a rear surface opposite the front surface; a frame part disposed between the front surface and the rear surface of the drawer panel and including an upper surface and a side surface; and a handle defined within at least one of the upper surface and the side surface of the frame part.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION OF EMBODIMENTS

Figure 1:
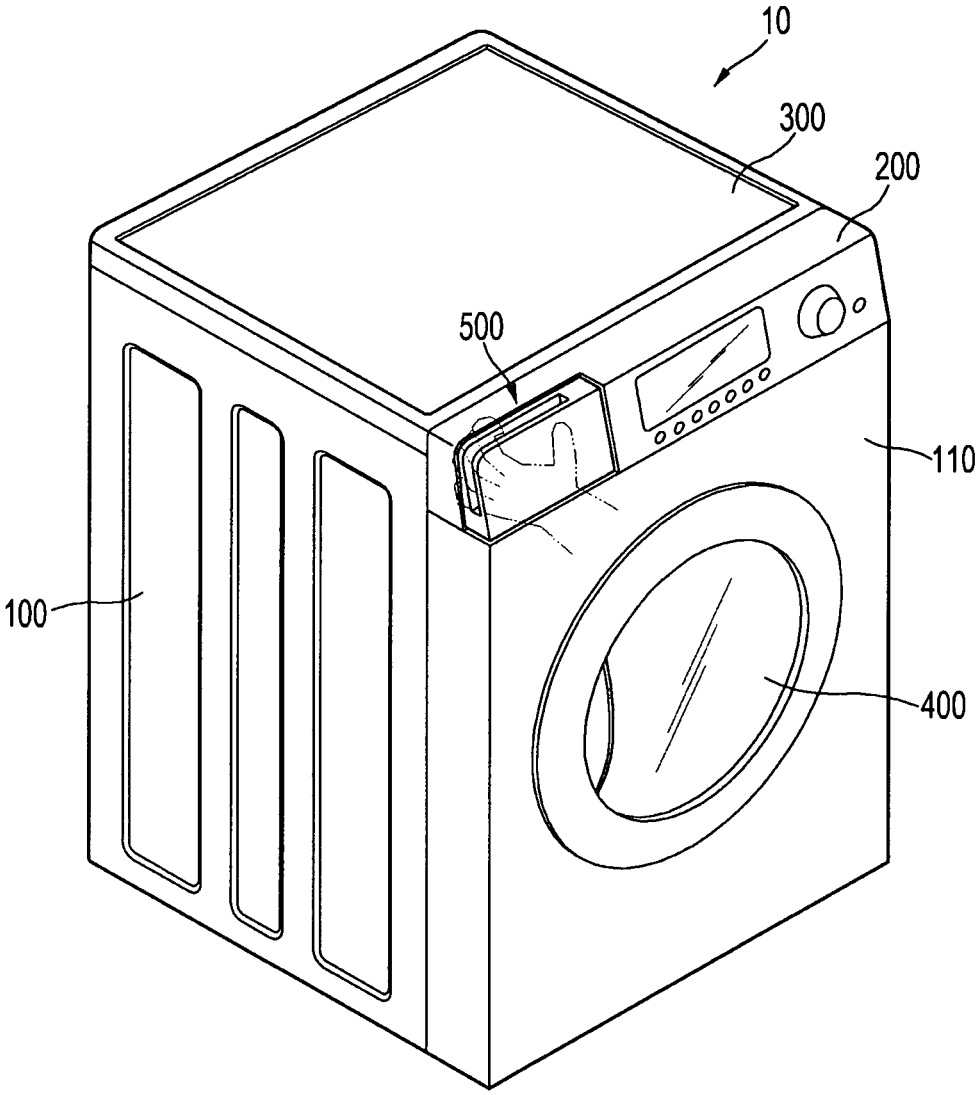
FIG. 1 is a perspective view illustrating an external appearance of a washing machine in accordance with an embodiment.

Reference will now be made in detail to the embodiments, examples of which are illustrated in the accompanying drawings, wherein like reference numerals refer to the like elements throughout.

Figure 2:
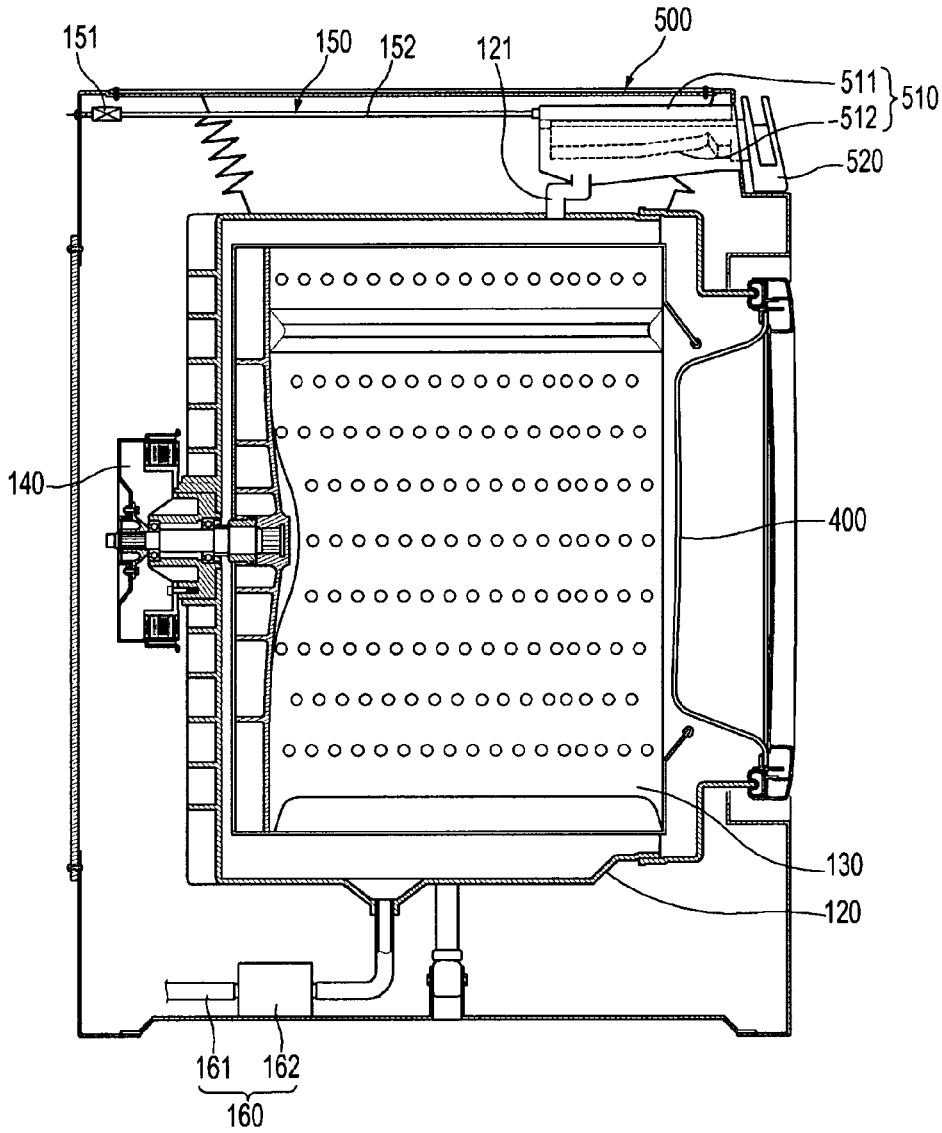
FIG. 2 is a longitudinal-sectional view illustrating an internal configuration of the washing machine in accordance with the embodiment.
Figure 3:
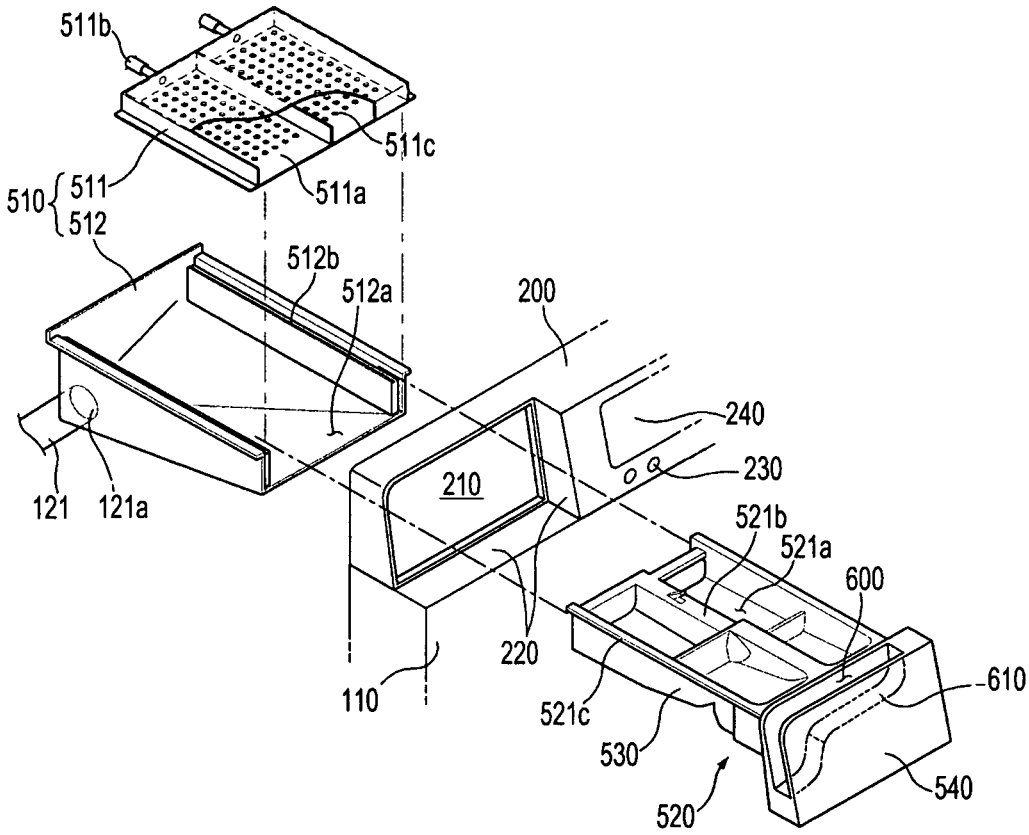
FIG. 3 is an exploded view illustrating a drawer assembly in accordance with the embodiment.

FIG. 1 is a perspective view illustrating an external appearance of a washing machine in accordance with an embodiment, FIG. 2 is a longitudinal-sectional view illustrating an internal configuration of the washing machine in accordance with the embodiment, and FIG. 3 is an exploded view illustrating a drawer assembly in accordance with the embodiment.

As shown in FIGS. 1 to 3, a washing machine 10 in accordance with the embodiment includes a washing machine main body 100 having a front cover 110 to protect the inside of the washing machine main body 100, a control panel 200 mounted at one side of the upper portion of the front cover 110 to control the operation of the washing machine 10, and a drawer assembly 500 formed at one side of the control panel 200 configured to be inserted into and removed from the washing machine main body 100.

A top plate 300 is mounted on the upper surface of the washing machine main body 100. A cylindrical tub 120 to contain washing water is installed in the washing machine main body 100, and a cylindrical drum 130 provided with a plurality of dehydration holes formed through the wall of the drum 130 is rotatably installed in the tub 120.

The control panel 200 is installed at the upper portion of the front cover 110. A detergent container reception hole 210, to which the drawer assembly 500 is connected, is formed through one side of the control panel 200, and a manipulation unit 230 to manipulate the operation of the drum washing machine and a display unit 240 to display the operation of the drum washing machine are formed at the other side of the control panel 200.

A driving motor 140, which rotates the drum 130 in the tub 120 in a regular direction or a reverse direction to perform washing, rinsing, and dehydrating courses is installed at the rear of the tub 120. Each of the tub 120 and the drum 130 is provided with an opening formed through the front surface thereof such that a user at the front of the washing machine main body 100 is able to remove laundry from the washing machine main body 10, and a door 400 to open and close the openings of the tub 120 and the drum 130 is installed at the front surface of the washing machine main body 100.

A water supply device 150 connected to the tub 120 through a water supply passage to supply washing water to the inside of the tub 120 is installed above the tub 120, and a drain device 160 including a drain pipe 161 and a drain pump 162 to forcibly drain the washing water in the tub 120 to the outside of the washing machine main body 100 after the washing of the laundry has been completed is installed below the tub 120.

The drawer assembly 500 to supply a detergent mixed with the washing water to the inside of the tub 120 is provided in the middle of the water supply passage between the water supply device 150 and the tub 120.

The water supply device 150 includes a water supply valve 151 connected to an external water supply hose (not shown) to control the supply of the washing water, and water supply pipes 152 forming the water supply passage together with the water supply hose (not shown) and connecting the water supply valve 151 and the drawer assembly 500.

The washing water supplied to the drawer assembly 500 flows into respective detergent input spaces 521*a* through upper portions of the respective detergent input spaces 521*a*, and moves to rear portions of the respective detergent input spaces 521*a* along inclined bottoms of the respective detergent input spaces 521*a*. Then, the detergent supplied to the respective detergent input spaces 521*a* is mixed with the washing water, and the detergent mixed with the washing water is continuously supplied to the tub 120 together with the washing water moving to the opened rear ends of the detergent input spaces 521*a* and an outlet 121*a* of a housing 510.

Figure 4:
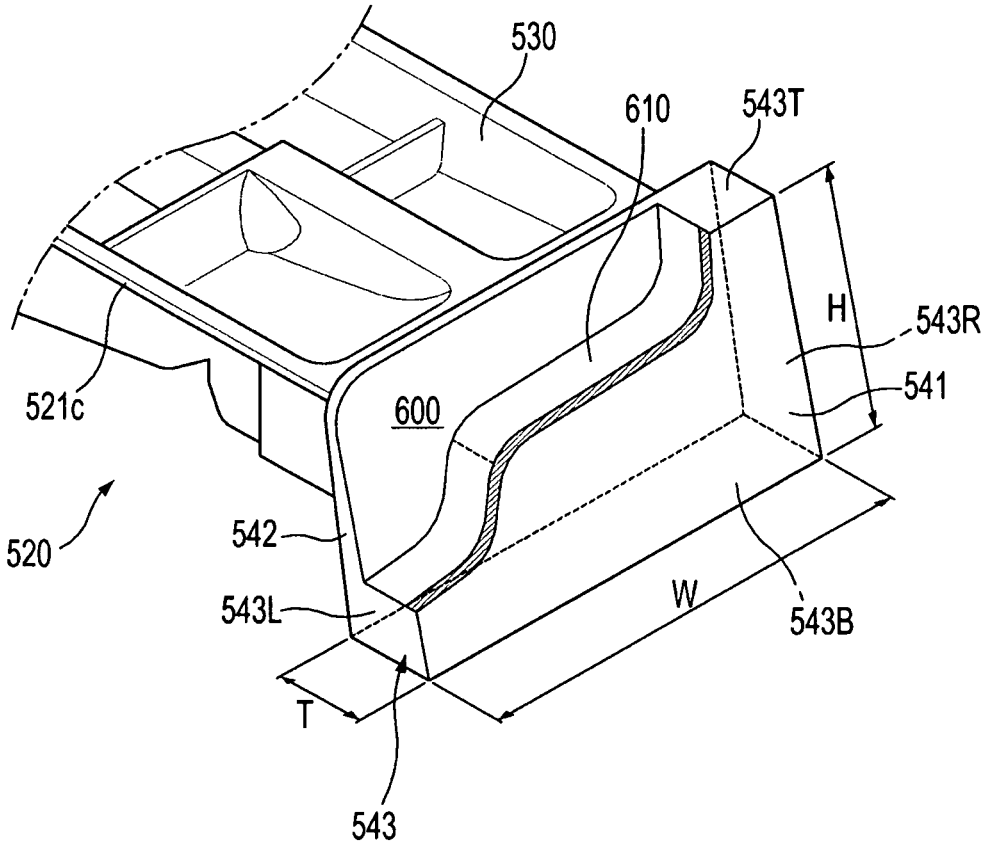
FIG. 4 is an enlarged view illustrating a detergent container of FIG. 3.
Figure 5:
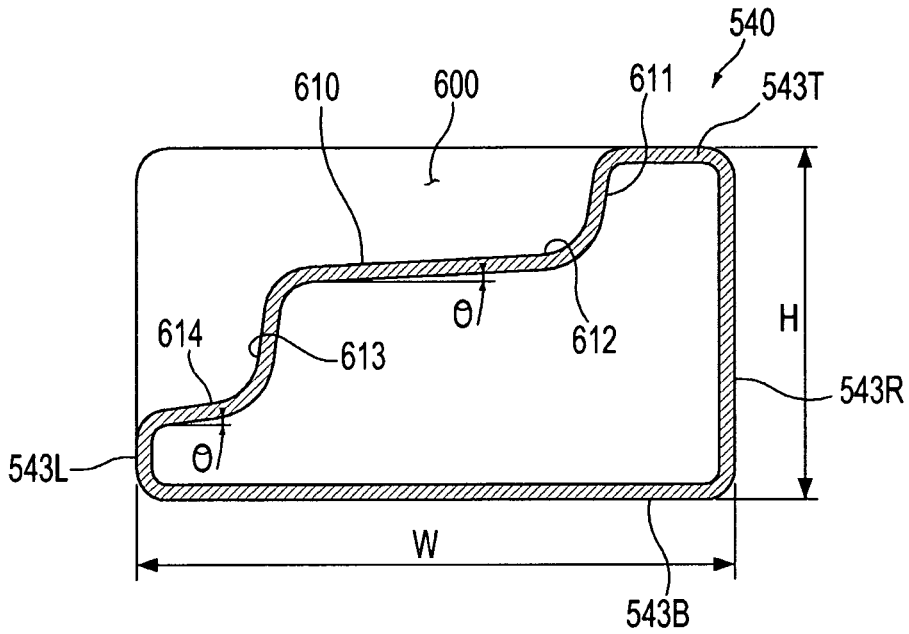
FIG. 5 is a longitudinal-sectional view illustrating a drawer panel of FIG. 3.

FIG. 4 is an enlarged view illustrating a detergent container of FIG. 3, and FIG. 5 is a longitudinal-sectional view illustrating a drawer panel of FIG. 3.

As shown in FIGS. 3 to 5, the drawer assembly 500 in accordance with the embodiment of the present invention includes the housing 510 having a box shape provided with an opening 512*a* formed through the front surface thereof, and a detergent container 520 detachably connected to the inside of the housing 510 through the opening 512*a* of the housing 510. The drawer assembly 500 is installed at the front region of the upper portion of the control panel 200 and allows the detergent container 520 to be attached to and detached from the housing 510 in a drawer type manner.

The housing 510 includes a lower case 512 forming an inner space to receive the detergent container 520 and provided with front and upper surfaces, which are opened, and an upper case 511 connected to the upper portion of the lower case 512 to cover the opened upper surface of the lower case 512.

A plurality of water supply channels 511*a*, which are divided from each other, is formed in the upper case 511, and a plurality of inlets 511*b*, to which the respective water supply pipes 152 are connected to supply water to the inside of the respective water supply channels 511*a* of the upper case 511, is formed at the rear end of the upper case 511. Through holes 511*c* to disperse the water supplied to the respective water supply channels 511*a* to the upper portion of the detergent container 520 are formed through the bottom of the upper case 511.

The lower case 512 is provided with the outlet 121*a* formed through the rear portion of the bottom of the lower case 512 and connected to a connection pipe 121 such that the water transmitted to the inside of the housing 510 is supplied to the tub 120, and the bottom of the lower case 512 is inclined downward to the outlet 121*a* such that the water in the housing 510 easily flows to the outlet 121*a*. Further, guide rails 512*b* to guide the attachment of the detergent container 520 to the housing 510 are respectively formed on the upper ends of both side surfaces of the lower case 512.

The detergent container 520 includes a detergent input unit 530 having the detergent input spaces 521*a* and being inserted into the inside of the housing 510, and a drawer panel 540 having a larger size than that of the detergent container reception hole 210 to cover the detergent container reception hole 210 when the detergent container 520 is inserted within the housing 510.

The detergent input unit 530 has a plurality of the detergent input spaces 521*a* to store various kinds of detergent, i.e., a detergent and a fabric rinse. That is, in order to input various kinds of detergent, the detergent input spaces 521*a*, which are divided from each other by diaphragms 521*b*, are formed in the detergent input unit 530, and the detergent input spaces 521*a* are formed in the direction in which the detergent container 520 is connected to the housing 510.

The detergent input spaces 521*a* correspond to the respective water supply channels 511*a* provided in the upper case 511, and the bottoms of the detergent input spaces 521*a* are inclined from the front parts thereof to the rear parts thereof. Through this configuration, the washing water supplied from the water supply device 150 to the tub 120 passes through the respective detergent input spaces 521*a* prior to being supplied to the tub 120, and various kinds of detergent input to the respectively detergent input spaces 521*a* are mixed with the washing water, and then are supplied to the inside of the tub 120 together with the washing water.

The outer surface of the drawer panel 540 is coplanar with the outer surface of the control panel 200 when the attachment of the detergent container 520 to the housing 510 is completed. Further, a frame part 543 of the drawer panel 540 corresponding to the left side surface is coplanar with the front cover 110. However, the drawer assembly 500, including the frame part 543 of the drawer panel 540, is not limited to such a structure. The frame part 543 of the drawer panel 540 may be situated at any position along the control panel 200 in cooperation with the housing 510 disposed within the washing machine.

That is, a panel seat part 220 formed on the control panel 200 and the front panel 110 is depressed from the outer surface of the control panel 200 corresponding to the shape and size of the drawer panel 540, and the drawer panel 540 is stably connected to the panel seat part 220 when the detergent container 520 is attached to the housing 510.

The drawer panel 540 has a rectangular plate shape, although is not limited to a rectangular shape, having a designated thickness, i.e., a rectangular parallelepipedal shape, and includes a front surface 541, a rear surface 542, and the frame part 543 connecting the front surface 541 and the rear surface 542.

The front surface 541 of the drawer panel 540 is provided with no space for a handle 600, but is flat so as not to detract from the beauty of the front surface of the washing machine.

The drawer panel 540 includes the frame part 543 connecting the front surface 541 and the rear surface 542 in the thickness (T) direction. The frame part 543 includes an upper surface 543T forming the upper frame of the drawer panel 540, a lower surface 543B forming the lower frame of the drawer panel 540, and side surfaces 543L and 543R forming both side frames of the drawer panel 540. The side surfaces 543L and 543R include a first side surface 543L forming the left frame of the drawer panel 540 and a second side surface 543R forming the right frame of the drawer panel 540. Here, the first side surface 543L is coplanar with the control panel (not shown) and the front cover (not shown), as described above, such that a user is able to easily approach the drawer panel 540 and a space for the handle is formed.

In the drawer panel 540 in accordance with the embodiment, the handle 600 is formed on the frame part 543 to allow the user to push and pull the detergent container 520 using the handle 600. A depression surface 610 is formed by depressing the frame part 543 of the drawer panel 540 in the height (H) direction and/or the width (W) direction, and a space for the handle 600 is formed between the frame part 543 and the depression surface 610.

The depression surface 610 is formed by depressing at least one of the upper surface 543T and the side surface 543L of the frame part 543 to the inside of the drawer panel 540.

That is, as shown in FIG. 5, the depression surface 610 is formed by depressing the upper surface 543T and the side surface 543L in the height (H) direction and the width (W) direction, thus forming the handle 600. However, the depression surface 610 in accordance with the embodiment may be formed by only depressing the upper surface 543T in the height (H) direction, or be formed by only depressing the side surface 543L in the width (W) direction. Hereinafter, the depression surface 610 formed by depressing the upper surface 543T and the side surface 543L in the height (H) direction and the width (W) direction will be described.

The depression surface 610 is formed as a curved surface, which is gradually lowered at a regular inclination. Further, the depression surface 610 is formed at a position that minimizes a height difference with the guide rails 512*b*, to which the detergent container 520 is connected. Concretely, the depression surface 610 includes a first bending surface 611 depressed from the upper surface 543T in the height (H) direction along the inside of the drawer panel 540, and a first seating surface 612 extended from the first bending surface 611 in the width (W) direction.

The first bending surface 611 is bent from the upper surface 543T to the inside of the drawer panel 540 to form a gap for the handle 600, and the first seating surface 612 is extended from the first bending surface 611 in the width (W) direction such that tips of user's fingers are able to catch the first seating surface 612. The first seating surface 612 is extended in a structure, which is rounded from the first bending surface 611 and is inclined. The first seating surface 612 has a designated inclination angle (θ).

The depression surface 610 may further include a second bending surface 613 depressed from the first seating surface 612 in the height direction (H), and a second seating surface 614 extended from the second bending surface 613 in the width direction (W). That is, the second bending surface 613 is bent from the first seating surface 612 to the inside of the drawer panel 540 to form a gap for the handle 600, and the second seating surface 614 connects the second bending surface 613 to the side surface 543L. The second seating surface 614 is extended in a structure, which is rounded from the second bending surface 613 and is inclined. The second seating surface 614 has a designated inclination angle (θ), although the inclination angles (θ) may or may not be equal to one another.

The first and second seating surfaces 612 and 614 extended from the first and second bending surfaces 611 and 613 have the designated inclination angle (θ), and the first side surface 543L is connected to the second seating surface 614 such that foreign substances, such as dust, are easily removed from the inside of the handle 600 of the drawer panel 540. Therefore, the foreign substances, such as dust, in the handle 600 easily move to the side surface 543L along the first and second seating surfaces 612 and 614.

In the embodiment, the first seating surface 612 may be longer in the width direction (W) than the second seating surface 614 such that tips of fingers contact the first seating surface 612. However, any one of the first seating surface 612 and the second seating surface 614 may be longer in the width direction (W) than the other one of the first seating surface 612 and the second seating surface 614.

Although the drawings illustrate that the depression surface 610 of the drawer panel 540 forming the handle 600 includes two bending surfaces 611 and 613 and two seating surfaces 612 and 614, the depression surface 610 may include one bending surface and one seating surface to connect the upper surface 543T to the side surface 543L. Further, the depression surface 610 in accordance with the embodiment may have a stepped structure including a plurality of bending surfaces and a plurality of seating surfaces to connect the upper surface 543T to the side surface 543L to form the handle 600.

Therefore, when a user puts his/her fingers into the handle 600 of the drawer panel 540, the user may be able to grip the handle 600. Then, the user applies force to the drawer panel 540 under the condition that the tips of the fingers contact the first seating surface 612 of the handle 600, and thus opens the detergent container 520.

Figure 6:
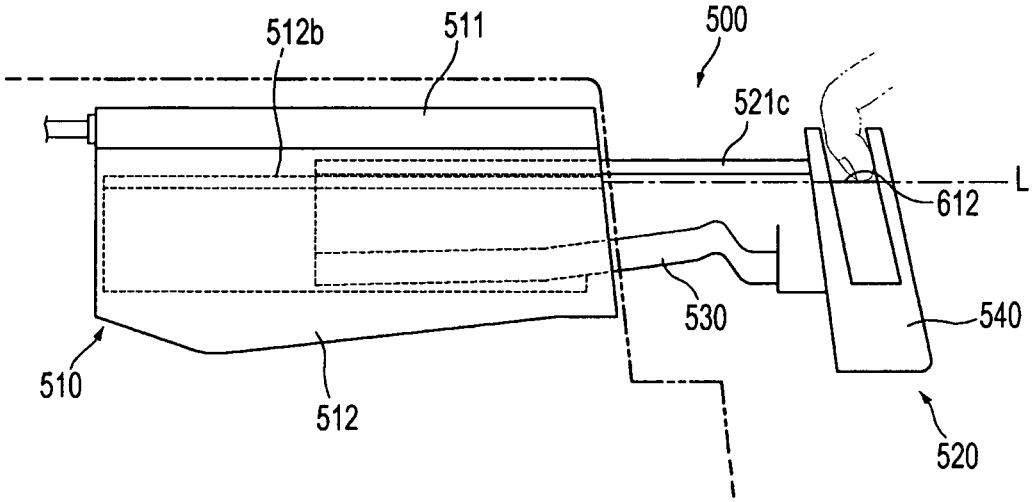
FIG. 6 is a view illustrating a state of the drawer assembly in accordance with the embodiment, in which the detergent container is separated from a housing of the drawer assembly.

FIG. 6 is a view illustrating a state of the drawer assembly in accordance with the embodiment, in which the detergent container is separated from the housing of the drawer assembly.

As shown in FIG. 6, the detergent container 520 in accordance with the embodiment includes sliding parts 521*c* formed on an outer wall of the detergent input unit 530. The sliding parts 521*c* are protruded along the outer surface of the detergent input unit 530, and are slidably connected to the guide rails 512*b* of the housing 510.

The sliding parts 521*c* of the detergent container 520 are latched onto the housing 510 through the guide rails 512*b*. The guide rails 512*b* are extended along the inner surface of the housing 510, and are in linear contact with the sliding parts 521*c*, thus allowing the detergent container 520 to be received in the housing 510.

The first seating surface 612 is disposed at the approximately same line L as the guide rails 512*b*, when the detergent container 520 is attached to the housing 510. When the first seating surface 612, to which tips of user' fingers catch, is disposed at the same line as the guide rails 512*b*, the detergent container 520 moves along the guide rails 512*b* without clattering of the detergent container 520, and thus the emotional quality of the detergent container is improved. Although the drawings illustrate that the first seating surface 612 is disposed at the approximately same line L as the guide rails 512*b* to generate the minimum height difference with the guide rails 512*b*, if the second seating surface 614 is longer in the width direction (W) than the first seating surface 612 and tips of user' fingers catch the second seating surface 614, the second seating surface 614 may be disposed at the approximately same line L as the guide rails 512*b*. However, the seating surfaces 612 and 614 may be disposed at any depth to be able to receive a user's fingertips.

Therefore, since the seating surface 612 or 614 of the drawer panel 540 is disposed at the same line W as the guide rails 512*b* of the housing 510, when the detergent container 520 moves into and out of the housing 510, the detergent container 520 is smoothly attached to and detached from the housing 510 to improve a consumer's emotion, and although the detergent container 520 is used for a long time, the deterioration in the smooth attachment and detachment of the detergent container 520 due to clattering is prevented.

As is apparent from the above description, in the washing machine and the drawer assembly thereof in accordance with the embodiment, a space for the handle is formed on the frame part of the drawer panel, and the depression surface forming the space for the handle is located at the same line as the guide rails of the housing, thus providing smooth attachment and detachment of the detergent container.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a washing machine main body;

a detergent container connected to the washing machine main body; and a drawer panel connected to the detergent container, wherein a handle of the drawer panel comprises:

a front surface;

a rear surface connected to the detergent container while being spaced apart from the front surface by a predetermined distance;

a frame part disposed between the front surface and the rear surface, the frame part including a left sidewall, a right sidewall, an upper wall and a lower wall; and a depression surface depressed from one point of the upper wall to one point of at least one of the left sidewall and the right sidewall of the frame part, the depression surface being formed as a curved surface and gradually inclined in a downward direction, wherein the handle is provided as a space formed by depressing the frame part from one point of the upper wall to one point of at least one of the left sidewall and the right sidewall.

2. The washing machine according to claim 1, further comprising:

a control panel to control an operation of the washing machine provided on the washing machine main body; and a front cover formed on a front surface of the washing machine main body, wherein an outer surface of the drawer panel is coplanar with outer surfaces of the control panel and the front panel when the detergent container is mounted to the washing machine main body.

3. The washing machine according to claim 1, wherein a front surface of the drawer panel is flat.

4. A washing machine, comprising:

a washing machine main body;

a detergent container connected to the washing machine main body; and a drawer panel connected to the detergent container, wherein a handle of the drawer panel comprises:

a front surface;

a rear surface connected to the detergent container while being spaced apart from the front surface by a predetermined distance;

a frame part disposed between the front surface and the rear surface, the frame part including a left sidewall, a right sidewall, an upper wall and a lower wall; and a depression surface depressed from one point of the upper wall to one point of at least one of the left sidewall and the right sidewall of the frame part, the depression surface including a first bending surface depressed from the upper wall in a height direction of the frame part, and a first seating surface extended from the first bending surface in a width direction of the frame part, and wherein the handle is provided as a space formed by depressing the frame part from one point of the upper wall to one point of at least one of the left sidewall and the right sidewall.

5. The washing machine according to claim 4, wherein the first seating surface is rounded from the first bending surface, and is inclined and extended.

6. The washing machine according to claim 4, further comprising:

a housing, to which the detergent container is connected, formed in the washing machine main body; and guide rails formed along an inner surface of the housing, wherein the first seating surface is disposed at a same line as the guide rails when the detergent container is attached to the housing.

7. The washing machine according to claim 4, wherein the depression surface further includes a second bending surface depressed from the first seating surface in the height direction, and a second seating surface extended from the second bending surface in the width direction so as to be connected with the side surface.

8. A washing machine, comprising:

a washing machine main body;

a detergent container housing disposed within the washing machine main body and including guide rails disposed on opposing sides thereof;

a detergent container connected to the detergent container housing through the guide rails; and a drawer panel connected to the detergent container, wherein a handle of the drawer panel comprises:

a front surface forming an external appearance of the drawer panel;

a rear surface connected to the detergent container while being spaced apart from the front surface; and a frame part including an upper wall, a lower wall, a left sidewall and a right sidewall while connecting the front surface to the rear surface, wherein the handle includes a depression surface forming a predetermined space provided by depressing the frame part from one point of the upper wall to one point of at least one of the left sidewall and the right sidewall that are connected to the upper wall so as to accommodate user's fingers at an inside the handle, and wherein the depression surface is gradually lowered toward one of the left sidewall and the right sidewall such that foreign substances introduced to the inside the handle flow down along the depression surface.

9. A drawer assembly, comprising:

a housing;

a detergent container detachably connected to the housing; and a drawer panel provided at a front surface of the detergent container, wherein a handle of the drawer panel comprises:

a front surface;

a rear surface connected to the detergent container while being spaced apart from the front surface by a predetermined distance;

a frame part disposed between the front surface and the rear surface, the frame part including a left sidewall, a right sidewall, an upper wall and a lower wall; and a depression surface depressed from one point of the upper wall to one point of at least one of the left sidewall and the right sidewall of the frame part, the depression surface includes at least one bending surface depressed from the upper surface in a height direction of the frame part, and at least one seating surface extended from the at least one bending surface in a width direction of the frame part, wherein the handle is provided as a space formed by depressing the frame part from one point of the upper wall to one point of at least one of the left sidewall and the right sidewall.

10. The drawer assembly according to claim 9, wherein:

the housing includes guide rails formed on opposing sides thereof to guide the attachment and detachment of the detergent container to and from the housing, and any one of the at least one seating surface is disposed at a same line as the guide rails.

* * * * *